United States Patent [19]

Dyer

[11] Patent Number: 4,918,933

[45] Date of Patent: Apr. 24, 1990

[54] ADD-ON REFRIGERANT BOILER FOR ELECTRIC HEAT PUMP

[76] Inventor: David F. Dyer, P.O. Box 2255, Auburn, Ala. 36831

[21] Appl. No.: 270,772

[22] Filed: Nov. 14, 1988

[51] Int. Cl.[5] ..... F25B 7/00

[52] U.S. Cl. ..... 62/79; 62/238.6; 62/238.7; 62/324.1; 165/29; 237/2 B

[58] Field of Search ..... 62/238.6, 238.7, 324.1, 62/321.7, 79; 237/2 B; 165/29

[56] References Cited

U.S. PATENT DOCUMENTS

| | | | |
|---|---|---|---|
| 4,112,705 | 9/1978 | Sisk et al. | 165/29 X |
| 4,191,023 | 3/1980 | Sisk et al. | 165/29 X |
| 4,409,796 | 10/1983 | Fisher | 62/324.1 X |
| 4,441,331 | 4/1984 | Yuyama | 165/29 X |
| 4,506,521 | 3/1985 | Asano et al. | 237/2 B X |
| 4,553,401 | 11/1985 | Fisher | 237/2 B X |

*Primary Examiner*—Lloyd L. King

[57] ABSTRACT

This invention relates to a method of supplying desired quantities of heat, generated from selected inexpensive fuel burns in the firebox of a boiler, to an electric heat pump's refrigerant, while operating in its heating cycle. This supply of heat can be of sufficient quantities to satisfy the total ouput of the heat pump, minimizing its use of electricity, thereby creating a substantial savings, as the cost of the heat generated by the inexpensive fuel used by the boiler is much less than the cost of electricity.

4 Claims, 3 Drawing Sheets

ADD-ON REFRIGERANT BOILER FOR ELECTRIC HEAT PUMP

BACKGROUND OF THE INVENTION

An electric heat pump is a mechanism that moves heat from one place to another. It can either remove heat from a specified enclosure and discharge this heat to the outside, or it can pick up heat from the outside and discharge it into the specified enclosure, thus it operates on either the heating cycle or the cooling cycle. The same mechanism is used for both cycles, but the travel of the refrigerant is reversed in order to change from cooling to heating.

The heat transfer coil mounted inside a specified enclosure or house is usually a standard finned coil with an air blower. The remaining components, compressor, coil, and etc., are housed outside, with appropriate connecting refrigerant lines.

On the heating cycle, the heat pump compressor is powered by electricity and pumps hot refrigerant to the inside heat exchanger coil with the air blower delivering said heat inside. The outside coil is used to pick up heat and it has been known to enhance the heat pump's performance by supplying a heat source to these outside coils, such as well water, lake water or even the ground itself.

However, this does not change the fact that the heat pump compressor is still powered by electricity, the cost of which has been continuously rising over the last several years.

SUMMARY OF THE INVENTION

The purpose of this invention is to provide an inexpensive method of supplying the needed heat to an electric heat pump's refrigerant during the heating cycle. By using a refrigerant boiler to produce this needed heat, cheaper fuels can be burned, thus creating a substantial saving between the cost of said fuel and the cost of electricity.

Various other features of the method of the present invention will become obvious to those skilled in the art upon reading the disclosure set forth hereinafter.

BRIEF DESCRIPTION OF DRAWINGS

Referring now to the drawings, the system is shown in cut-away views of a house showing locations of the heat pump's compressor/coil unit outside, its coil and return air fan unit inside, its connecting refrigerant lines, and the connecting refrigerant boiler.

DETAILED DESCRIPTION

Figure 1:
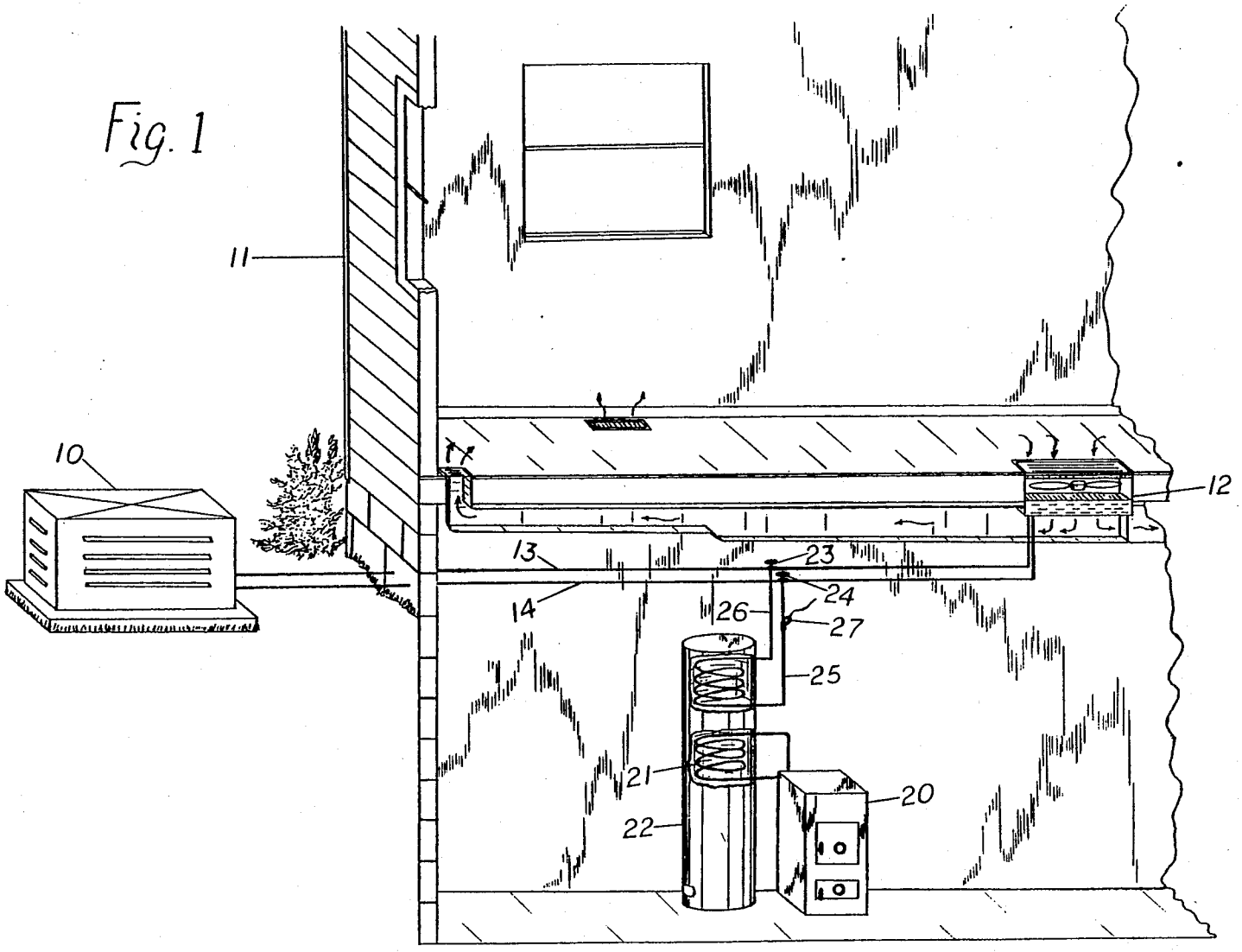
FIG. 1 is a cut-away view showing the system and the refrigerant boiler heating a liquid storage tank, which then heats the heat pump's refrigerant.
Figure 2:
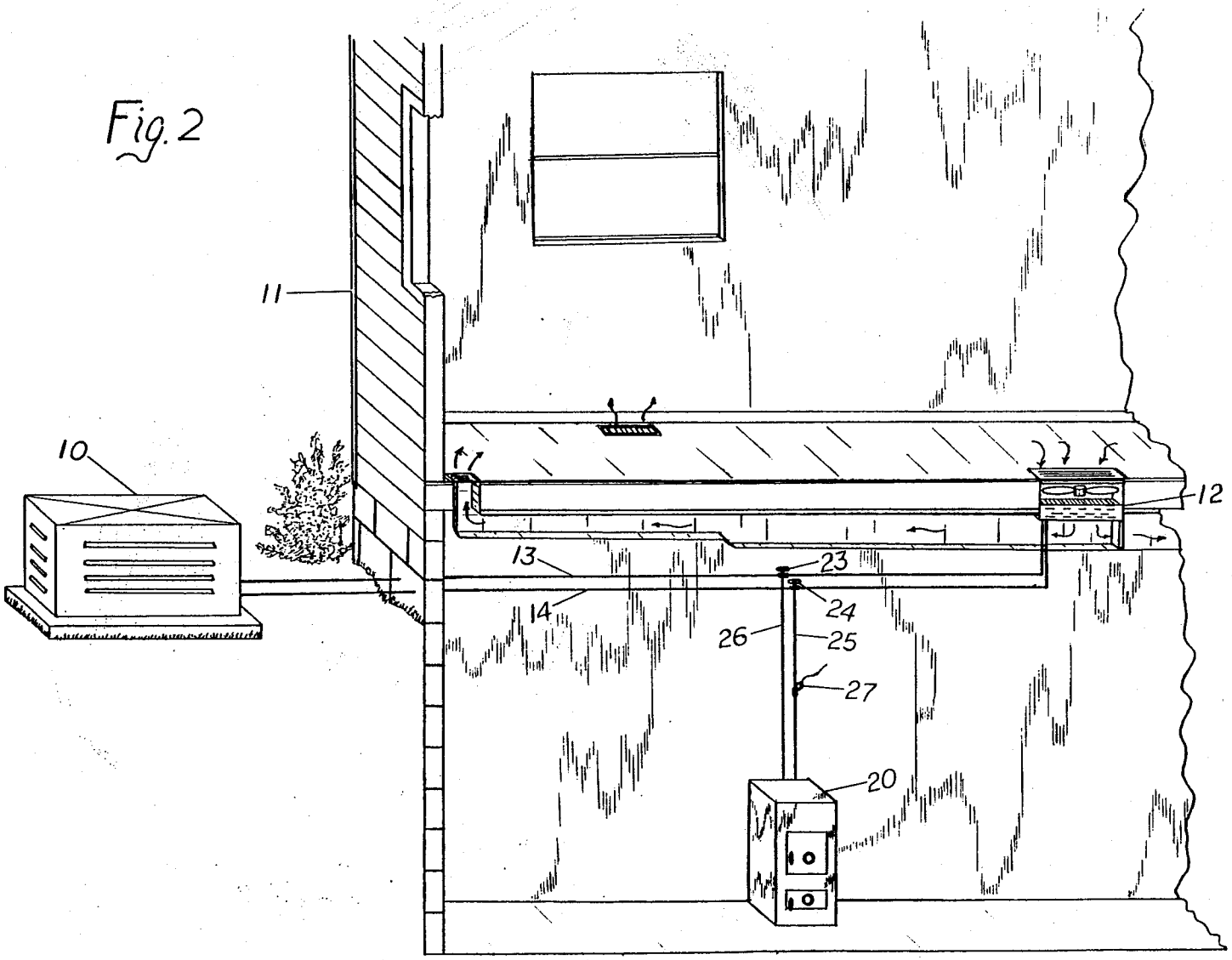
FIG. 2 is a cut-away view showing the system and the refrigerant boiler heating the heat pump's refrigerant.
Figure 3:
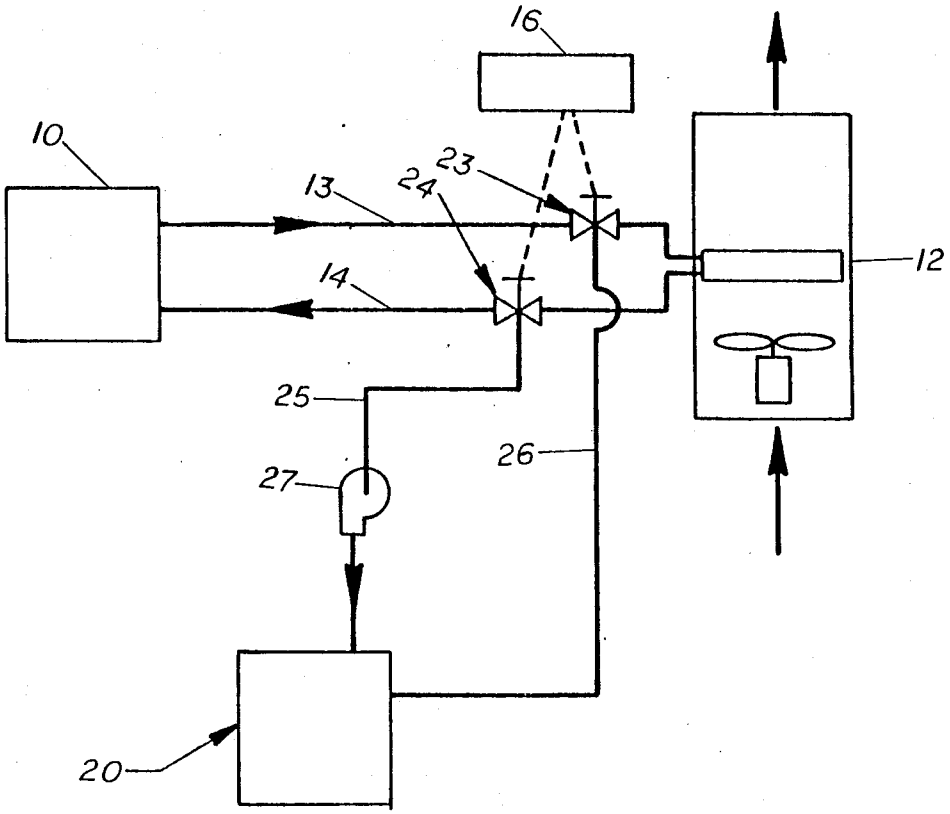
FIG. 3 is a layout of the system and illustrates how its function can be controlled automatically.

Referring now to FIGS. 1 through 3, there are illustrations showing various views of the system and its functions with the heat pump's refrigerant. FIG. 1 shows the electric heat pump's compressor/coil unit 10 located outside of a cut-away view of house 11 and connected to the inside return air fan and coil unit 12 by two refrigerant pipe lines 13 and 14. On the heat pump's heating cycle, coil unit 12 gives off heat inside with the outside coil/compressor unit 10 picking up heat from the outside. Electricity is used to power the compressor, which pumps the hot refrigerant through pipe line 13 to the inside coil unit 12, and there gives up its heat with pipe line 14 used to return said refrigerant to the coil/compressor unit 10 to pick up additional outside heat.

Refrigerant boiler 20 is shown located in the basement of the house 11 and has heat exchanger coils 21 connecting its hot water supply to the water or liquid storage tank 22, thus heating the contents of said storage tank. Valves 23 and 24 connect refrigerant lines 25 and 26 to refrigerant lines 13 and 14, with said lines 25 and 26 extending into the upper end of hot water or liquid storage tank 22 in a coil fashion forming a loop and with pump 27 mounted on line 25, refrigerant can then be pumped from the heat pump pipe line 14, circulated and heated through the coils in the hot liquid storage tank and returned through pipe line 26 to heat pump pipe line 13, which routes the refrigerant back through inside coil unit 12, thus delivering heat from refrigerant boiler inside house 11 for use. This heat supplied by refrigerant boiler 20 can be generated by a low cost fuel that is much less expensive than the cost of the electricity used to power the heat pump, thus reducing the cost of operation. Refrigerant boiler 20 and associated equipment could be located outside house 11 to eliminate venting of flue gas and associated safety problems.

FIG. 2 illustrates how the refrigerant boiler 20 can have the refrigerant lines 25 and 26 forming a loop and passing directly through the boiler 20 and delivering heat from said boiler, as the refrigerant is circulated by pump 27 back through pipe line 26, through valve 23 and into pipe line 13 that delivers the heated refrigerant back through the inside coil 12 for use inside house 11.

FIG. 3 shows a layout of the electric heat pump 10 and its components and its refrigerant lines 13 and 14 connected at valves 23 and 24 to lines 25 and 26, which deliver refrigerant, pumped by pump 27, through refrigerant boiler 20 for heating. The system as shown can be operated either as a conventional heat pump system or with the refrigerant boiler as the heat source. As a conventional heat pump, the two valves 23 and 24 are positioned to open the line 13 and 14 to and from the compressor/coil unit 10 of the existing heat pump. This valve position closes the lines to and from the refrigerant boiler 20. The valve positioning is accomplished either manually or automatically with a controller 16, which can range from either an on-off switch to an elaborate computer-based controller interfaced with various input/output devices such as an energy management system. The controller 16 would reverse the valve 23 and 24 positions for operation with the refrigerant boiler 20 and would turn on a pump 27 to circulate refrigerant. The pump 27 outlet pressure would be equivalent to the pressure produced by the compressor unit 10. It is understood that the control could be caused to produce a mixed output of both the compressor/coil unit 10 and the refrigerant boiler 20.

The refrigerant boiler 20 can be fired with fuel such as natural gas, propane, fuel oil, or other fuel such as wood. The boiler could be a unit in which heat is transferred directly from the flame to refrigerant, as illustrated in FIG. 2, or the heat from the flame could be transferred to an intermediate fluid such as water or a heat transfer oil, as illustrated in FIG. 1.

The main advantage of the improved system, as previously pointed out, is that the heating can be accomplished with the refrigerant boiler using a fuel supply which is cheaper than electricity. At current fuel and electric costs and heat pump performance, a typical four ton unit would use about $400 more electricity as a heat pump than fuel to the refrigerant boiler to heat a house in the winter.

It is to be understood that the foregoing drawings and description of the invention is to be taken as a preferred embodiment and that various other modifications will occur to those skilled in the art upon reading the disclosure, however all changes and modifications that come within the spirit of the invention are desired to be protected.

I claim:

1. A method of supplying desired quantities of heat to the refrigerant of an electric heat pump, comprising the steps of a. positioning an electric heat pump to operate in its heating cycle, with the compressor adjusted to function as desired, b. positioning a boiler near the heat pump, c. positioning a liquid storage tank near the boiler, d. installing means of transferring heat from the fired boiler into the liquid storage tank, said means consisting of liquid transfer pipes and coils, e. connecting and adjusting at least one controllable valve to each heat pump pipe line that carries refrigerant to its heating or condensing coils and away from said coils, f. installing refrigerant heat pipe coils inside the hot liquid storage tank and connecting same to the two controllable valves, forming a loop for conveying the refrigerant through the hot liquid storage tank, g. installing a pump in the refrigerant pipe line that connects the controllable valve, installed in the heat pump refrigerant line that carries refrigerant away from its heating or condensing coils, to the refrigerant heat pipe coils located inside the hot liquid tank, said pump positioned to circulate the refrigerant from the heat pump pipe line through said refrigerant heat pipe coils in the liquid storage tank, thus picking up heat produced by the boiler burn, and back up through the loop and the other controllable valve into the heat pump pipe line that carries said hot refrigerant into the heat pump heat or condenser coils, where said heat is released.

2. The method in claim 1 and further comprising the step of installing a central controller for controlling all functions of all components of the system.

3. A method of supplying desired quantities of heat to the refrigerant of an electric heat pump, comprising the steps of a. positioning an electric heat pump to operate in its heating cycle, with the compressor adjusted to function as desired, b. positioning a boiler near the heat pump, c. connecting and adjusting at least one controllable valve to each heat pump pipe line that carries refrigerant to its heating or condensing coils and away from said coils, d. installing refrigerant heat pipe coils in the boiler and connecting same to the two controllable valves, forming a loop for conveying the refrigerant, e. installing a pump in the refrigerant pipe line that connects the controllable valve, installed in the heat pump refrigerant line that carries refrigerant away from its heating or condensing coils, to the refrigerant heat pipe coils located in the boiler, said pump positioned to circulate the refrigerant from the heat pump pipe line through said refrigerant heat pipe coils in the boiler, thus picking up heat produced by the boiler burn, and back up through the loop and the other controllable valve into the heat pump pipe line that carries said hot refrigerant into the heat pump heating or condensing coils, where said heat is released.

4. The method in claim 3 and further comprising the step of installing a central controller for controlling all functions of all components of the system.

* * * * *